US008420986B2

(12) United States Patent
Hendricks et al.

(10) Patent No.: US 8,420,986 B2
(45) Date of Patent: Apr. 16, 2013

(54) FREQUENCY-MODULATED ELECTRIC ELEMENT CONTROL

(75) Inventors: Donald Hendricks, Caryville, TN (US); David Nowak, Powell, TN (US); Phil Springer, Knoxville, TN (US)

(73) Assignee: BSH Home Appliances Corporation, Irvine, CA (US)

( * ) Notice: Subject to any disclaimer, the term of this patent is extended or adjusted under 35 U.S.C. 154(b) by 500 days.

(21) Appl. No.: 12/719,878

(22) Filed: Mar. 9, 2010

(65) Prior Publication Data

US 2011/0220636 A1 Sep. 15, 2011

(51) Int. Cl.
*H05B 1/02* (2006.01)

(52) U.S. Cl.
USPC ..... 219/494; 219/715; 219/721

(58) Field of Classification Search ..... 219/494, 219/715, 721
See application file for complete search history.

(56) References Cited

U.S. PATENT DOCUMENTS

| | | | | |
|---|---|---|---|---|
| 4,623,781 | A | 11/1986 | Thomas | |
| 4,933,535 | A | 6/1990 | Zabinski | |
| 5,029,244 | A | 7/1991 | Fowler | |
| 5,253,564 | A | 10/1993 | Rosenbrock et al. | |
| 5,925,278 | A | 7/1999 | Hirst | |
| 5,977,530 | A * | 11/1999 | Bessho et al. | 219/715 |
| 6,140,621 | A | 10/2000 | Ho et al. | |
| 6,252,209 | B1 | 6/2001 | Liepold | |
| 6,818,869 | B2 | 11/2004 | Patti et al. | |
| 6,849,830 | B2 | 2/2005 | Damiano et al. | |
| 7,075,044 | B2 * | 7/2006 | Ryu et al. | 219/626 |
| 7,151,242 | B2 | 12/2006 | Schuler | |
| 7,176,424 | B2 | 2/2007 | Kim | |
| 7,271,372 | B2 | 9/2007 | Liu et al. | |
| 7,282,680 | B2 * | 10/2007 | Ryu | 219/661 |
| 7,579,702 | B2 | 8/2009 | Park et al. | |
| 7,579,716 | B2 * | 8/2009 | Sato et al. | 307/80 |
| 2003/0155349 | A1 * | 8/2003 | Matsuo et al. | 219/664 |
| 2003/0213371 | A1 | 11/2003 | Saunders | |
| 2007/0212102 | A1 * | 9/2007 | Yano | 399/88 |
| 2007/0274736 | A1 * | 11/2007 | Sato et al. | 399/88 |

* cited by examiner

*Primary Examiner* — Toan Le
(74) *Attorney, Agent, or Firm* — James E. Howard; Andre Pallapies

(57) ABSTRACT

A system, method, and computer-readable medium for controlling power applied to a heating element. A rectifier receives AC voltage supplied from an AC voltage supply and rectifies the AC voltage to DC voltage. A pulse-width modulation controller generates and transmits a pulse-width modulation signal, and a DC voltage modulator receives the DC voltage from the rectifier and the pulse-width modulation signal from the pulse-width modulation controller. Based on the pulse-width modulation signal, the DC voltage modulator supplies an analog DC voltage signal to the heating element. A feedback circuit reports the actual DC voltage applied to the heating element to a microcontroller and, if the actual DC voltage deviates from the DC voltage encoded in the pulse-width modulation signal, the pulse-width modulation controller modulates the pulse-width modulation signal to minimize or eliminate the deviation.

19 Claims, 5 Drawing Sheets

FREQUENCY-MODULATED ELECTRIC ELEMENT CONTROL

BACKGROUND OF THE INVENTION

The present invention generally relates to frequency-modulated electric element control, and more particularly to an apparatus, a method, and computer-readable medium for varying DC power supplied to a heating element.

Heating elements are installed, for example, in home appliances such as ovens, washers, and dryers. In an oven, for example, AC power may be supplied to a bake heating element, a convector heating element, and a broil heating element in order to heat up the air in the oven cavity to a target temperature set by the user of the oven.

FIG. 1 shows a block diagram of components of an exemplary system 10 in the related art for providing AC power to a heating element. The exemplary system 10 includes a user input device 20; a comparator 30; a temperature sensor 40; an AC power supply 50; a switch 60; and a heating element 70.

A user of an oven, for example, may utilize the user input device 20 to set a target temperature $T_{target}$ for the air inside the oven cavity. The user input device 20 may be, for example, a knob or a keypad that is located, e.g., at a front panel of the oven. The target temperature $T_{target}$ may be, for example, in the range from 200° F. to 500° F. The target temperature $T_{target}$ is then provided to the comparator 30, e.g., a microcontroller, which compares the target temperature $T_{target}$ to an actual temperature $T_{actual}$ of the air inside the oven cavity. The actual temperature $T_{actual}$ is supplied to the comparator 30 by the temperature sensor 40, which may be located inside or in close proximity to the oven cavity, for example.

FIG. 2*a* shows an exemplary temperature curve of the actual temperature $T_{actual}$ in, for example, an oven cavity of the related art. The user may set the target temperature $T_{target}$ at time $t_0$. If, at time $t_0$, the comparator 30 determines that the target temperature $T_{target}$ is higher than the actual temperature $T_{actual}$, and if the difference between the target temperature $T_{target}$ and the actual temperature $T_{actual}$ is equal to or greater than a predetermined amount ΔT, the comparator 30 instructs the switch 60 to switch on the AC power from the AC power supply 50 so that AC power is now supplied to the heating element 70. The switch 60 may be, for example, a proportional-integral-derivative (PID) controller.

The AC power supplied to the heating element 70 may be in the order of 2000 Watts, as shown in FIG. 2*b*. Since AC power is now supplied to the heating element 70, the heating element 70 heats up and, as a result, the actual temperature $T_{actual}$ of the air inside the oven cavity rises, as shown in FIG. 2*a*. This operational mode of the oven may be referred to as the preheating mode.

The temperature sensor 40 periodically senses the actual temperature $T_{actual}$ and forwards it to the comparator 30 for comparison to the target temperature $T_{target}$ set by the user at time $t_0$. If the comparator 30 determines at time $t_1$ that the target temperature $T_{target}$ is equal to the actual temperature $T_{actual}$, as shown in FIG. 2*a*, the comparator 30 instructs the switch 60 to switch off the AC power to the heating element 70, as shown in FIG. 2*b*. The oven may now enter an operational mode that may be referred to as a baking mode or cooking mode.

Even though the AC power to the heating element 70 is now turned off, the actual temperature $T_{actual}$ of the air inside the oven cavity continues to rise for a certain period of time, as shown in FIG. 2*a*, due to residual heat dissipation from the heating element 70 into the oven cavity.

As the heating element 70 cools down, the temperature sensor 40 continues to periodically sense the actual temperature $T_{actual}$ and continues to periodically supply the actual temperature $T_{actual}$ to the comparator 30 for comparison with the target temperature $T_{target}$. If, at time $t_2$, the comparator 30 determines that the target temperature $T_{target}$ is higher than the actual temperature $T_{actual}$ and that the difference between the two temperatures is equal to or greater than the predetermined amount ΔT, as shown in FIG. 2*a*, the comparator 30 once again instructs the switch 60 to switch on the AC power to the heating element 70, as shown in FIG. 2*b*. This switching on and off of AC power to the heating element 70 now continues until the user turns off the oven. For example, as shown in FIG. 2*b*, the AC power to the heating element 70 is turned on at times $t_4$ and $t_6$, and turned off at times $t_3$, $t_5$, and $t_7$ in response to the actual temperature curve of FIG. 2*a*.

As can be seen in FIG. 2*b*, when the switch 60 turns on the AC power to the heating element 70 at $t_0$, $t_2$, $t_4$, etc., it is always the full AC power of, e.g., 2000 Watts that is applied to the heating element 70. This application of the full AC power leads to high power consumption, in particular during the preheating mode, and to inrush currents to the heating element 70, which is the leading cause for heating element breakdown and, ultimately, heating element failure.

Furthermore, as apparent from FIG. 2*a*, the switching on and off of the full AC power in the related art leads to overshoots and undershoots of the target temperature $T_{target}$ by relatively large degrees so that the target temperature $T_{target}$ can only be approximated within a certain, relatively large interval. This is because the system 10 waits until the temperature sensor 40 detects a significant difference ΔT between the target temperature $T_{target}$ and the actual temperature $T_{actual}$ before the switch 60 applies the full AC power to the heating element 70. As noted above, by the time the temperature sensor 40 senses that the actual temperature $T_{actual}$ equals the target temperature $T_{target}$, the heating element 70 is fully heated and, even though the switch 60 switches off the AC power to the heating element 70, residual heat in the heating element 70 continues to produce heat in the oven cavity until the heating element 70 cools off. The resulting overshoots and undershoots of the target temperature lead to uneven cooking or baking of the food in the, e.g., oven cavity.

BRIEF SUMMARY OF THE INVENTION

A first aspect of the disclosure provides a system for controlling power applied to a heating element. The system includes an AC voltage supply to supply AC voltage; a rectifier to rectify the AC voltage supplied from the AC voltage supply to a predetermined DC voltage level; a pulse-width modulation controller to generate and transmit a pulse-width modulation signal; and a DC voltage modulator to receive the predetermined DC voltage level and to supply an analog DC voltage signal to the heating element based on the pulse-width modulation signal.

A second aspect of the disclosure provides a method for controlling power applied to a heating element. The method includes supplying AC voltage from an AC voltage supply; rectifying the AC voltage supplied by the AC voltage supply to a predetermined DC voltage level; generating a pulse-width modulation signal; switching the predetermined DC voltage level on and off in accordance with the pulse-width modulation signal; generating an analog DC voltage signal based on the switching of the predetermined DC voltage level in accordance with the pulse-width modulation signal; and supplying the analog DC voltage signal to the heating element.

A third aspect of the disclosure provides a computer-readable medium having computer-readable instructions recorded thereon for controlling power applied to a heating element. The computer-readable instructions include determining a target temperature for a medium heated up by the heating element; determining an actual temperature of the medium heated up by the heating element; comparing the target temperature to the actual temperature; determining a temperature comparison result that is based on the comparison of the target temperature to the actual temperature; and modulating a pulse-width modulation signal based on the temperature comparison result to generate an analog DC voltage signal that is supplied to the heating element.

BRIEF DESCRIPTION OF THE SEVERAL VIEW OF THE DRAWING

These and other features of this disclosure will be more readily understood from the following detailed description of the various aspects of the disclosure taken in conjunction with the accompanying drawings that depict various embodiments of the disclosure, in which:

FIG. 1 shows a block diagram of components of an exemplary system in the related art for providing AC power to a heating element;

FIG. 2*a* shows an exemplary temperature curve of the actual temperature of air heated by a heating element in the related art;

FIG. 2*b* shows the switching on and off of full AC power supplied to a heating element in the related art;

DETAILED DESCRIPTION OF THE INVENTION

Figure 1:
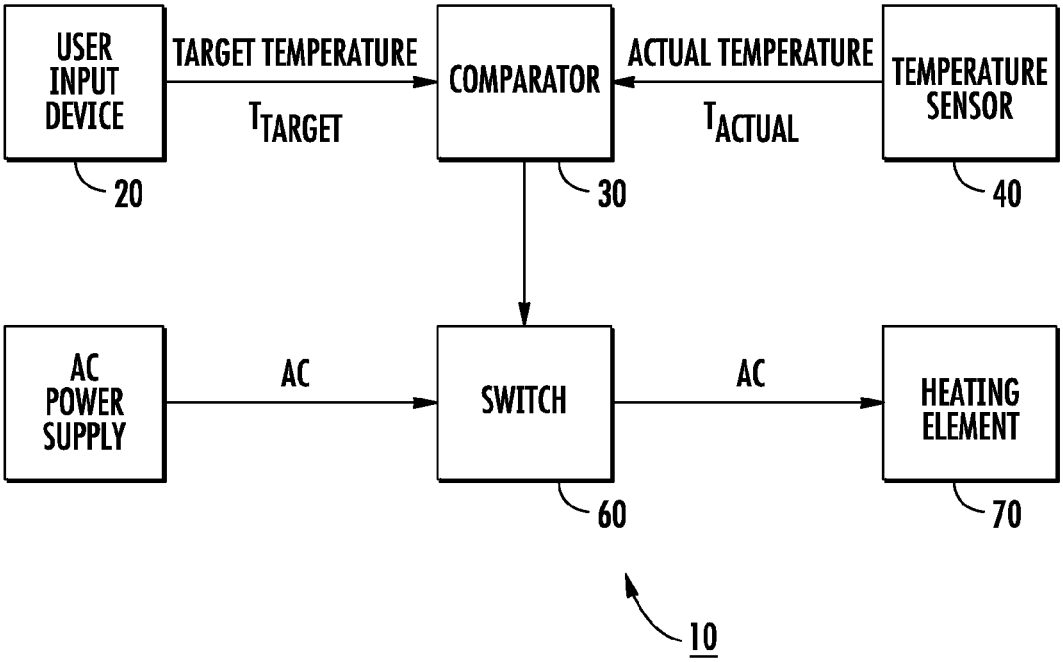
FIG. 1 RELATED ART
Figure 2A:
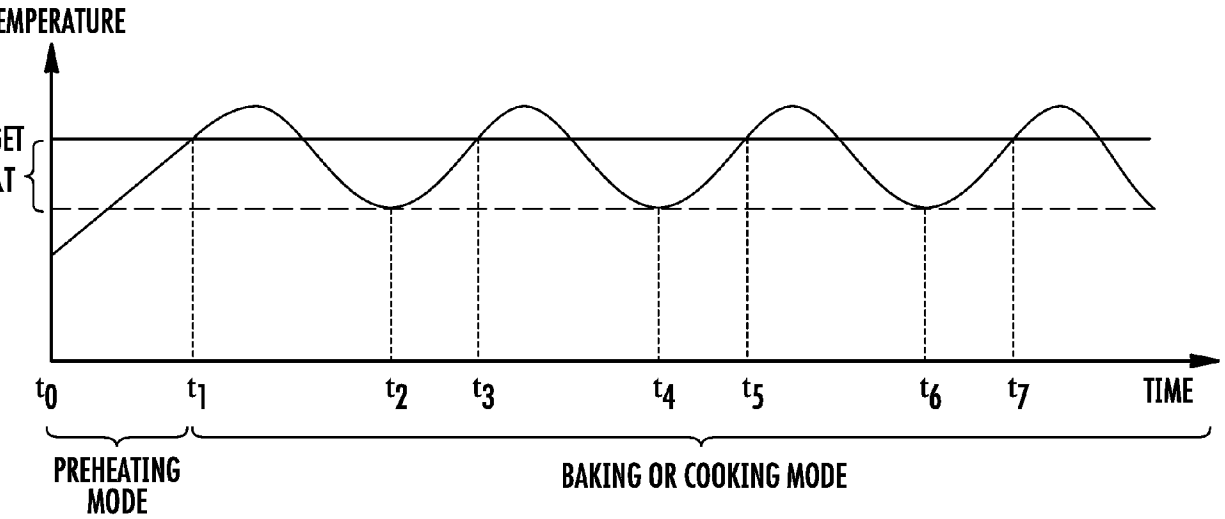
FIG. 2A RELATED ART
Figure 2B:
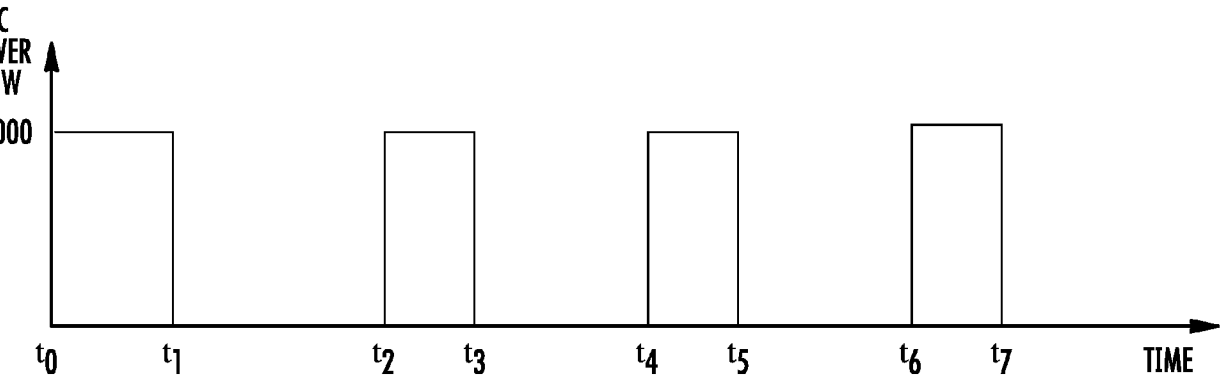
FIG. 2B RELATED ART
Figure 3:
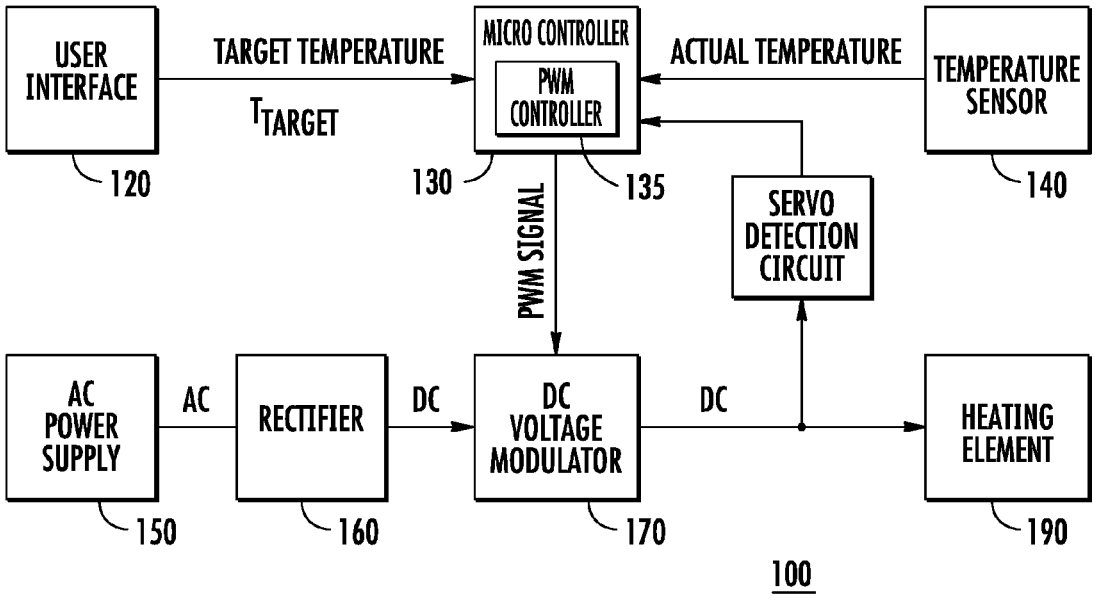
FIG. 3 shows a block diagram of a system for applying analog DC power to a heating element in accordance with an exemplary embodiment of the present invention.

FIG. 3 shows a block diagram of an exemplary embodiment of a system 100 in accordance with the present invention.

A user of an oven, for example, may utilize a user input device or user interface 120, such as a knob or a keypad that may be located, e.g., at a front panel of the oven, to set a target temperature $T_{target}$ for air inside the oven cavity. A microcontroller 130 then compares the target temperature $T_{target}$ to the actual temperature $T_{actual}$ of the air inside the oven cavity. The actual temperature $T_{actual}$ is provided by a temperature sensor 140, which may be located inside or in close proximity to the oven cavity, for example.

If the target temperature $T_{target}$ is higher than the actual temperature $T_{actual}$, a pulse-width-modulation (PWM) controller 135 of the microcontroller 130 generates a PWM signal that instructs a DC voltage modulator 170 to supply DC power to a heating element 190. The DC power is provided by a rectifier 160 that rectifies AC voltage from an AC power supply 150 to DC voltage. The PWM controller may be a digital on-chip component of the microcontroller 130 or a digital component that is separate from the microcontroller 130, for example. The DC voltage modulator 170 may be, for example, an Insulated-Gate Bipolar Transistor (IGBT) and the heating element 190 may be, for example, a bake heating element, a convector heating element, or a broil heating element of an oven. However, the heating element 190 may be any other heating element of any other appliance or any other device, such as washers, dryers, cooktops, toaster ovens, etc. The rectifier 160 and the DC voltage modulator 170 may be part of a single component or they may be separate components.

Since DC power is now supplied from the DC voltage modulator 170 to the heating element 190, the heating element 190 heats up and, as a result, the actual temperature $T_{actual}$ of the air inside the oven cavity rises. The temperature sensor 140 periodically detects the actual temperature $T_{actual}$ and the microprocessor 130 periodically compares the detected actual temperature $T_{actual}$ to the target temperature $T_{target}$ set by the user. Depending on the temperature comparison result, the PWM controller 135 modulates the pulse widths of the PWM signal so that the duration of the on-times and off-times of the DC voltage modulator 170 is varied.

For example, if the microprocessor 130 determines that the actual temperature $T_{actual}$ is higher than the target temperature $T_{target}$, the PWM controller 135 may generate a PWM signal with a decreased duty cycle, i.e., with a decreased "on" time during a regular cycle. A decreased duty cycle means that a lower desired DC voltage value is encoded in the PWM signal. Thus, the DC power applied to the heating element 190 is reduced. Consequently, the heating element 190 cools down and the actual temperature $T_{actual}$ of the air in the oven cavity decreases. If the actual temperature $T_{actual}$ drops below the target temperature $T_{target}$, the PWM controller 135 may increase the duty cycle of the PWM signal again. This means that a higher desired DC voltage value is encoded in the PWM signal and, as a result, the DC power applied to the heating element 190 is increased. Thus, the actual temperature $T_{actual}$ in the oven cavity rises again.

Since the, e.g., IBGT and other electronic components of the exemplary system 100 may be subjected to considerable heat, and since properties of the IBGT and other electronic components may change depending on their temperature, the actual DC voltage value that is actually applied to the heating element 190 may deviate from the desired DC voltage value that was encoded in the PWM signal and that was supposed to be applied to the heating element 190. To correct such deviations, the exemplary system 100 includes a feedback circuit 180 that reports the actual DC voltage value applied to the heating element 190 back to the microcontroller 130 for comparison to the desired DC voltage value that was encoded in the PWM signal. If the actual DC voltage value deviates from the desired DC voltage value, the PWM controller 135 makes the necessary adjustments to the duty cycle of the PWM signal so that these deviations are minimized or eliminated. The feedback circuit 180 may be referred to as a Servo Detection amplifier or Servo Detection circuit, for example.

Figure 4:
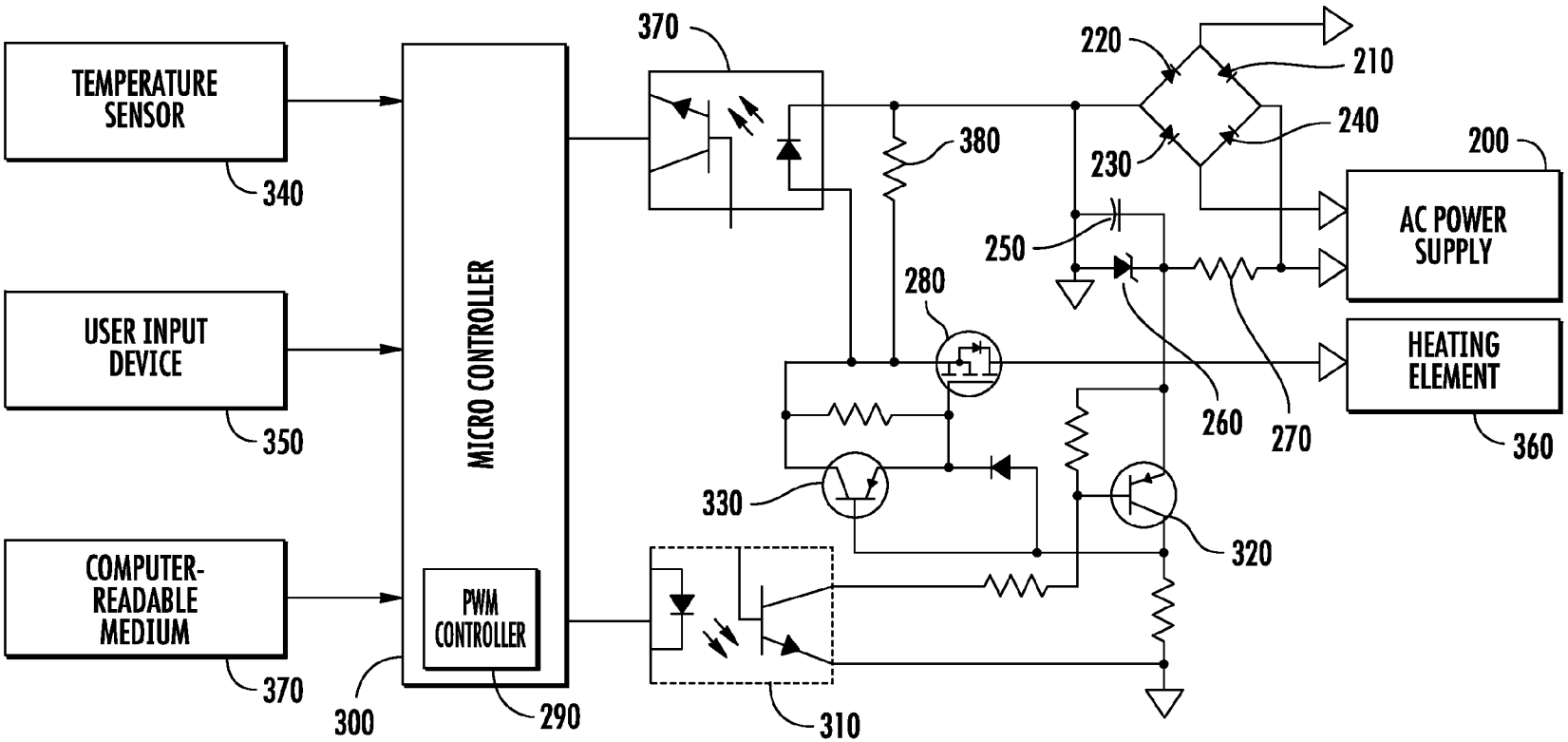
FIG. 4 shows a schematic of an electric circuit for applying analog DC power to a heating element in accordance with an exemplary embodiment of the present invention.

FIG. 4 shows an exemplary embodiment of a schematic electric circuit in accordance with the present invention.

AC voltage from an AC power supply 200 may be rectified to a predetermined DC voltage level by a rectifier that includes, for example, diodes 210, 220, 230, 240; a capacitor 250; a Zener diode 260, and a resistor 270. A microcontroller 300 compares the actual temperature $T_{actual}$ detected by a temperature sensor 340 to the target temperature $T_{target}$ provided by a user input device or user interface 350. A PWM controller 290, which may be, for example, a digital on-chip PWM controller of the microcontroller 300, generates the duty cycle variations of a PWM signal in accordance with the temperature comparison result and supplies the PWM signal to an IBGT 280 via an optocoupler 310 and a transistor 320.

An "on" signal from the PWM controller 290 excites the optocoupler 310 and, thus, causes a signal to the transistor 320. This provides a positive 15V signal to the Gate of the IBGT 280. A transistor 330 is inoperative at this time because of a reverse bias on its Base-Emitter junction. The positive 15V signal from the transistor 320 to the Gate of the IBGT 280 turns the IBGT 280 on so that the full, predetermined DC voltage level from the rectifier is now switched on. Upon cessation of the positive 15V signal from the transistor 320 to the Gate of the IBGT 280, the transistor 330 turns on and discharges the Gate of the IBGT 280, thereby switching off the full, predetermined DC voltage level from the rectifier. This switching on and off of the full, predetermined DC voltage level occurs at a high frequency rate of about 1,200 cycles per second, for example. Since, for example, the rectified input frequency is 2 times the line frequency of 60 cycles per second, i.e., 120 cycles per second, the full, predetermined DC voltage level may be switched 10 times during the time period in which DC power is applied to the heating element 360.

As a result of this rapid switching of the IBGT 280, the heating element 360 is too slow to respond to the switching on and off of the full, predetermined DC voltage level. Consequently, the DC voltage signal applied to the heating element 360 is an analog signal. This analog DC voltage signal can be easily modulated in accordance with the duty cycle variations of the PWM signal from the PWM controller 290. In other words, the constant switching on and off of the full AC power to the heating element in the related art is eliminated. Instead, an easily variable analog DC voltage signal is applied to the heating element 360.

As explained in the description of FIG. 3 above, since properties of the IBGT, the transistors 320, 330 and other electronic components of the circuit shown in FIG. 4 may change depending on the temperature they are subjected to, the circuit of FIG. 4 includes a feedback circuit that reports the actual DC voltage value applied to the heating element 360 to the microcontroller 300. The feedback circuit may include an optocoupler 370 and a resistor 380 and may be referred to as a Servo Detection amplifier or Servo Detection circuit, for example. As noted above, the microcontroller 300 compares the actual DC voltage value applied to the heating element 360 to the desired DC voltage value that was encoded in the PWM signal from the PWM controller 290 and that was supposed to be applied to the heating element 360. The PWM controller 290 then corrects any deviations between these two DC voltage values by making adjustments to the duty cycle of the PWM signal so that these deviations are minimized or eliminated.

The exemplary circuit shown in FIG. 4 may also include a computer-readable medium 370 to store instructions for the microcontroller 300 to perform various methods in accordance with exemplary embodiments of the present invention. The computer-readable medium may be, for example, part of the microcontroller 300 or a component that is separate from the microcontroller 300, such as an EPROM, USB stick, flash drive, floppy disk, CD, etc.

Figure 5:
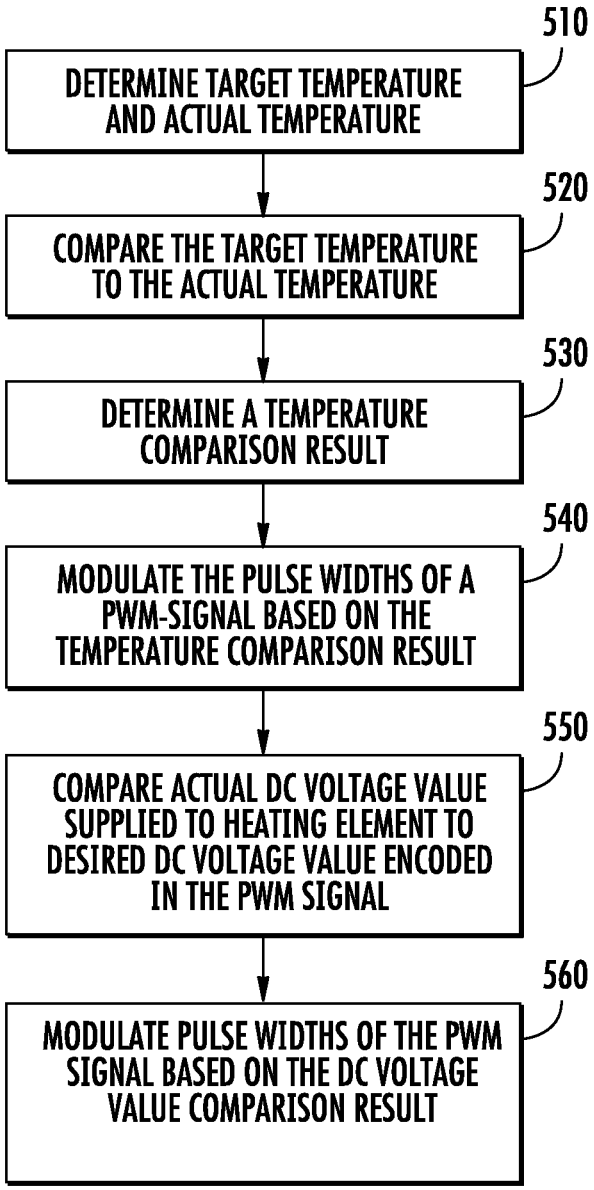
FIG. 5 shows a flowchart of an exemplary method in accordance with an exemplary embodiment of the present invention.

As shown in the flowchart of FIG. 5, the instructions recorded on the computer-readable medium may, for example, include instructions to determine 510 the target temperature $T_{target}$ set by the user via the user input device or user interface 350 and the actual temperature $T_{actual}$ detected by the temperature sensor 340. The instructions may further include comparing 520 the target temperature $T_{target}$ to the actual temperature $T_{actual}$; to determine 530 the temperature comparison result; and to modulate 540 the pulse-widths of the pulse-width modulation signal generated by the PWM controller 290 based on the temperature comparison result. In addition, the instructions recorded on the computer-readable medium may compare 550 the actual DC voltage value supplied to the heating element 360 to the desired DC voltage value encoded in the PWM signal and modulate 560 the pulse widths of the PWM signal based on the DC voltage value comparison result.

As a result of applying an easily variable analog DC voltage signal to the heating element 390, and as a result of the continuous feedback reporting of the actual DC voltage value that was applied to the heating element 360 in accordance with the exemplary embodiments of the present invention described above, the overshoots and undershoots of the target temperature $T_{target}$ are drastically reduced or even eliminated. Consequently, food in an, e.g., oven can be more uniformly baked or cooked than in the related art. Furthermore, the power consumption of an, e.g., oven, can be reduced by at least 25%-30% during a typical baking mode. Also, in an oven, for example, all three heating elements (baking heating element, convection heating element, broil heating element) can be heated up simultaneously as compared to the simultaneous heating up of only two heating elements in the related art. This means that the preheating time can be reduced, which leads to further power consumption savings.

Since the constant switching on and off of full power to the heating element is eliminated, the inrush currents to the heating element in the related art are eliminated. Consequently, the lifecycle of the heating element is much longer and the heating element may be made of less expensive material. For example, while heating elements in the related art may be made of the expensive Incology material, heating elements used in exemplary embodiments of the present invention may be made of less expensive stainless steel. Moreover, an optocoupler and separate, isolated 12V AC low power systems provide for isolation of the, e.g., IBGT from the microcontroller.

The description of the present disclosure has been presented for purposes of illustration and description only, but is not intended to be exhaustive or limited to the disclosure in the form disclosed. Many modifications and variations will be apparent to those of ordinary skill in the art without departing from the scope and spirit of the disclosure. For example, while exemplary embodiments of the present invention may have been described in the context of an oven, the present invention can be applied to any other appliance or device that utilizes heating elements.

What is claimed is:

1. A home appliance having a heating element and a system for controlling power applied to the heating element, the home appliance comprising:

a user interface to set a target temperature for a medium heated up by the heating element;

a temperature sensor to detect an actual temperature of the medium heated up by the heating element;

a microcontroller to receive the target temperature from the user interface and the actual temperature from the temperature sensor; to compare the target temperature to the actual temperature; and to determine a temperature comparison result that is based on the comparison of the target temperature to the actual temperature;

a pulse-width modulation controller to generate and transmit a pulse-width modulation signal based on the temperature comparison result; and a DC voltage modulator to receive a predetermined DC voltage level and to supply an analog DC voltage signal to the heating element based on the pulse-width modulation signal.

2. The home appliance of claim 1, wherein the pulse-width modulation controller modulates the pulse-width modulation signal based on the temperature comparison result.

3. The home appliance of claim 1, further comprising:

a feedback circuit between the DC voltage modulator and the microcontroller;

wherein the pulse-width modulation controller encodes a desired DC voltage value in the pulse-width modulation signal;

wherein the DC voltage modulator supplies an actual DC voltage value to the heating element;

wherein the feedback circuit reports the actual DC voltage value to the microcontroller; and wherein the microcontroller compares the actual DC voltage value to the desired DC voltage value and determines a DC voltage value comparison result that is based on the comparison of the actual DC voltage value to the desired DC voltage value.

4. The home appliance of claim 3, wherein the pulse-width modulation controller modulates the pulse-width modulation signal based on the DC voltage value comparison result.

5. The home appliance of claim 3, wherein the pulse-width modulation controller varies the desired DC voltage value encoded in the pulse-width modulation signal based on the temperature comparison result.

6. The home appliance of claim 3, wherein the pulse-width modulation controller varies the desired DC voltage value encoded in the pulse-width modulation signal based on the DC voltage value comparison result.

7. The home appliance of claim 1, wherein the DC voltage modulator includes an Insulated-Gate Bipolar Transistor.

8. A method for controlling power applied to a heating element within a home appliance, the method comprising:

determining a target temperature for a medium heated up by the heating element;

determining an actual temperature of the medium heated up by the heating element;

comparing the target temperature to the actual temperature;

determining a temperature comparison result that is based on the comparison of the target temperature to the actual temperature; and generating a pulse-width modulation signal based on the temperature comparison result to generate an analog DC voltage signal; and supplying the analog DC voltage signal to the heating element.

9. The method of claim 8, further comprising:

setting a target temperature for a medium heated up by the heating element.

10. The method of claim 9, further comprising modulating the pulse-width modulation signal based on the temperature comparison result.

11. The method of claim 9, further comprising:

encoding a desired DC voltage value in the pulse-width modulation signal;

supplying an actual DC voltage value to the heating element;

comparing the actual DC voltage value to the desired DC voltage value; and determining a DC voltage value comparison result based on the comparison of the actual DC voltage value to the desired DC voltage value.

12. The method of claim 11, further comprising modulating the pulse-width modulation signal based on the DC voltage value comparison result.

13. The method of claim 11, further comprising varying the desired DC voltage value encoded in the pulse-width modulation signal based on the temperature comparison result.

14. The method of claim 11, further comprising varying the desired DC voltage value encoded in the pulse-width modulation signal based on the DC voltage value comparison result.

15. A home appliance having a computer-readable medium with computer-readable instructions recorded thereon for controlling power applied to a heating element of the home appliance, the computer-readable instructions comprising:

determining a target temperature for a medium heated up by the heating element;

determining an actual temperature of the medium heated up by the heating element;

comparing the target temperature to the actual temperature;

determining a temperature comparison result that is based on the comparison of the target temperature to the actual temperature; and modulating a pulse-width modulation signal based on the temperature comparison result to generate an analog DC voltage signal that is supplied to the heating element.

16. The home appliance of claim 15, wherein the computer-readable instructions further comprise:

encoding a desired DC voltage value in the pulse-width modulation signal;

comparing an actual DC voltage value supplied to the heating element to the desired DC voltage value; and determining a DC voltage value comparison result based on the comparison of the actual DC voltage value to the desired DC voltage value.

17. The home appliance of claim 16, wherein the computer-readable instructions further comprise modulating the pulse-width modulation signal based on the DC voltage value comparison result.

18. The home appliance of claim 16, wherein the computer-readable instructions further comprise varying the desired DC voltage value encoded in the pulse-width modulation signal based on the temperature comparison result.

19. The home appliance of claim 17, wherein the computer-readable instructions further comprise varying the desired DC voltage value encoded in the pulse-width modulation signal based on the DC voltage value comparison result.

* * * * *